United States Patent [19]

Van Doorne

[11] 4,075,112

[45] Feb. 21, 1978

[54] GREASE COMPOSITION

[75] Inventor: Guy Camille Van Doorne, Zellik, Belgium

[73] Assignee: Labofina S.A., Brussels, Belgium

[21] Appl. No.: 699,853

[22] Filed: June 25, 1976

Related U.S. Application Data

[63] Continuation-in-part of Ser. No. 544,687, Jan. 28, 1975, abandoned, which is a continuation-in-part of Ser. No. 327,787, Jan. 29, 1973, abandoned.

[51] Int. Cl.[2] ..... C10M 1/24; C10M 3/18; C10M 5/14; C10M 7/20

[52] U.S. Cl. ..... 252/35; 252/59

[58] Field of Search ..... 252/35, 37.7, 59

[56] References Cited

U.S. PATENT DOCUMENTS

| | | | |
|---|---|---|---|
| 2,526,986 | 10/1950 | Whitney | 252/35 |
| 3,083,160 | 3/1963 | Agius et al. | 252/59 |
| 3,100,808 | 8/1963 | Dyer | 208/18 |
| 3,285,851 | 11/1966 | Dyer | 252/59 |
| 3,663,726 | 5/1972 | Waring | 252/35 |

*Primary Examiner*—Delbert E. Gantz
*Assistant Examiner*—Irving Vaughn

[57] ABSTRACT

A lubricating grease comprised of 2 to 8% by weight of an aluminum fatty acid soap, 25 to 98% by weight of a polymer of hydrogenated polyisobutylene having a mean molecular weight ranging from 300 to 2500, 0.2% polyisobutylene having a mean molecular weight higher than 100,000 and about 2 to 58% of lubricating oil.

8 Claims, No Drawings

GREASE COMPOSITION

The present invention is a continuation-in-part of my co-pending application, Ser. No. 544,687, filed Jan. 28, 1975, in turn a continuation-in-part of application Ser. No. 327,787, both now abandoned filed Jan. 29, 1973, and relates to new lubricating greases which are particularly stable and it also relates to a process for the manufacture of such greases.

In a companion application, Ser. No. 699,854 filed herewith, greases are taught in which polybutene oil is incorporated as a substantial component. That polybutene oil of that invention is amber colored typical of polybutene oils conventionally known. The present application is directed to hydrogenated polybutene oil similar to U.S. Pat. No. 3,100,808 to have little unsaturates if any whereby it is colorless but substantially improved in lubricating effect as a grease. This oil, however, to provide continued lubrication in a wide temperature range exceeding that in which the hydrogenated oils are normally stable may contain mineral lubricating oil either used in small quantities, such as 2 to 5%, whereby the colorless character is substantially maintained, or even larger quantities where the color is not a critical factor. The mineral lubricating oil, however, greatly improves the stability and temperature range in which the present grease can be used.

Heretofore, most of the lubricating greases have been prepared from a mineral or synthetic oleaginous vehicle or base oil with addition of a thickening agent to obtain the desired consistency. Thickening agents are most often soaps of fatty acids or inorganic agents, such as colloidal silica, bentonite, and the like.

These known greases are gels, the thickening agent forming a network wherein the oil is incorporated. However, difficulties have been encountered in the manufacture of a homogeneous and stable gel. Such difficulties are due to many factors, such as type of thickening agent, type of base oil, amounts of these components, the process for manufacturing the grease, etc. The influence of these factors are not yet well known.

Therefore, by incorporating polymers into lubricating greases to enhance some of their properties, further difficulties are encountered. For example, some olefin polymers, namely polymers of ethylene or propylene or co-polymers of ethylene with higher 1-olefins, have been suggested as thickening agents. However, the gels formed are not sufficiently stable and tend to break down under mechanical stresses with formation of too fluid products (see U.S. Pat. No. 3,112,270). Also, it has been observed that polyisobutylenes produced by low-pressure polymerization are not suitable as thickening agents and attempts to prepare valuable greases from these polymers have failed (German Pat. No. 1,091,683). It also has been proposed to incorporate polymers into lubricating greases in order to avoid bleeding of the greases with separation of the oil from the network formed by the thickening agent. Such composition generally contain less than 10 to 12% of a polyisobutylene having a mean molecular weight higher than 2500 and more particularly, from 10,000 to 11,000, i.e. less than about 3%.

An object of the present invention, is to provide a homogeneous, stable and effective lubricating grease.

Another object of the present invention is to provide a simple process for preparing lubricating greases with smaller amounts of thickening agent and other additives to reach the desired performance.

SUMMARY OF THE INVENTION

In fulfillment of these and other objects, the present invention is a lubricating grease comprising 2 to 15%, preferably 3 to 8% by weight of aluminum soap, 25 to 97%, preferably 35 to 87% by weight of a hydrogenated polymer of monoolefinic hydrocarbon having 4 carbon atoms and having a mean molecular weight of between 300 and 2500, and 0 to 60% by weight of lubricating oil, usually at least 2% of lubricating oil, and preferably from 10 to 48% of mineral lubricating oil. The hydrogenated polybutene may be prepared as shown in U.S. Pat. No. 3,100,808.

The process for preparing these lubricating greases comprises dispersing 2 to 15% by weight, based on the composition, of aluminum soap first into 10 to 50% by weight of a polymer of monoolefinic hydrocarbon having 4 carbon atoms, said polymer having a mean molecular weight of between 300 and 2500, at 15°-50° C. That dispersion is progressively heated and when adding 2 to 58% by weight of lubricating oil thereto when the temperature reaches 90° to 110° C, then slowly adding with continued heating 15 to 48% by weight of a hydrogenated polymer of olefinic hydrocarbon having 4 carbon atoms, said polymer having a mean molecular weight of between 300 and 2500, until the temperature reaches 150° to 180° C, and then cooling this mixture and homogenizing said mixture at 10° to 35° C.

It has been found that the lubricating greases of the present invention which contain the relatively low molecular weight hydrogenated polymer of butene or isobutylene are smooth, homogeneous and particularly stable, thus making these greases particularly effective. This result is unexpected because according to the prior art, it has been conventional practice to employ polymers having a high molecular weight and to add them in low proportions for preventing any prejudicial action on the stability and the lubricating action of the greases.

The present grease has other most surprising advantages. For instance, a solid grease is available using aluminum soap in the relatively small quantity, for instance, as low as 2%. Greases made with other soaps generally require more soap. Even in the case of aluminum soaps of fatty acids it was thought to require at least 10% of soap used with heavy polymer oil to form a solid grease. The present invention can use much lower quantities of aluminum soap to form a solid grease. Again, it was thought that to make a grease, much working was required for most oils including polymer oils. The present polymeric oil can form a grease with little working having a penetration or consistency index in the range of about 285 to 340 indicating good penetration as compared to other known greases using a comparatively small amount of aluminum soap clearly indicating the superiority of this type of grease. Finally, the grease is a better lubricant with a very low wear index. For instance, grease having a wear index in the range of 0.60 to 0.75 are formed as set forth in the examples below indicating the surprising superiority of the present grease.

DESCRIPTION OF THE PREFERRED EMBODIMENTS

The aluminum soap or thickening agent employed in the grease composition of the present invention generally is used in an amount ranging from about 2 to 15%, more particularly from 3 to 8% based on the weight of the grease. This aluminum soap is most often a soap of a saturated or unsaturated higher aliphatic carboxylic acid, containing from about 12 to 20 carbon atoms, e.g. stearic, oleic, ricinoleic or palmitic acid. Mixed aluminum soaps, which are soaps obtained from a higher aliphatic carboxylic acid and from a carboxylic acid with a lower molecular weight, may be used. Examples of such aluminum soaps include soaps of benzostearic, acetopalmitic, toluostearic acids, etc.

By substituting an alkali or alkaline earth metal soap for an aluminum soap, the other conditions remaining the same, it has been observed that the lubricating grease is somewhat softer. Therefore, the amount of soap required to prepare a grease having a given consistency is higher with an alkali or alkaline earth metal soap than with an aluminum soap. Thus, the aluminum soaps are economically more advantageous and are preferred.

The lubricating oil employed in the lubricating grease of the present invention is any mineral, such as aromatic or naphthenic oil, a highly naphthenic oil being preferably used for the manufacture of greases having a high thermal stability. Synthetic lubricating oils also may be used, e.g. esters of sebacic or adipic acid and of alcohols with 6 to 12 carbon atoms, such as 2-ethylhexanol. The oil is used in an amount not higher than 60% and ranging more often from 10 to 50% by weight of the grease. The consistency of the greases generally increases when the amount of oil decreases. It also is advisable to use oils or mixtures of oils with a viscosity index varying from 10 to 100 or even higher and preferably, between 30 and 70.

The linear polymer of butene or isobutylene most commonly used in the composition of the present invention is a hydrogenated liquid homopolymer with a mean molecular weight of between about 300 and 2500. This polymer may be the sole oleaginous component of the grease when the soap is below 8% in the grease and the amount of hydrogenated polymer by weight in the grease may then reach 98%. However, the amount of polymer which is required in preparing a grease with high consistency, stability and performances is at least 25% based on the weight of the composition and usually will range only up to 87% when more aluminum soap and at least 2% of mineral oil is used. Mixtures of these polymers may also be used, for example, a blend of two or more of such polymers of different molecular weights or a mixture of nonhydrogenated polymer and hydrogenated polymer, etc.

In preparing greases according to the present invention, about 2 to 15%, based on the weight of the grease, of aluminum soap is dispersed into about half the required amount of hydrogenated polybutene or polyisobutylene. That is to say that such amount is dispersed into about 10 to 50% by weight of polymer. This dispersion is carried out while continuously stirring at a temperature of about 10° to 50° C. The mixture obtained is progressively heated until a temperature of about 110° C is reached and the oil is added. The temperature is further raised to about 150°-180° C and the remaining amount of polymer is progressively added while stirring, the temperature being maintained between 150°-180° C temperature range. As indicated above, the later added polymer may be different from the polymer used in the first step of the process. The mixture is then cooled and when at room temperature, it is homogenized in a colloidal mill or any known and convenient homogenizer.

Other compounds may be incorporated in the grease. For example, extreme-pressure additives, anti-corrosive agents, colouring agents, high molecular weight polymers improving the adhesiveness of the grease on metallic surfaces, such as polyisobutylene having a molecular weight higher than 100,000 may be added. The amount of these additives generally is not higher than 2 to 3% by weight of the grease.

The components of the grease according to the present invention, that is the aluminum soap, the polymer of $C_4$ monoolefine and the lubricating oil, when used in the above stated proportions, form unique mixtures with specific properties. It has been found that the required amount of aluminum soap to be used as a thickening agent and the required amount of adhesiveness improver are lower in the greases of the present invention than in conventional greases. The substitution of this soap or of this polymer by another homologue has a detrimental effect on the performance of the grease.

The following examples are given to illustrate the present invention. These examples are not to be construed as limiting the invention however. In these examples, reference is made to the following tests:

ASTM D 217-52T or penetration test, which is a measure of consistency and mechanical stability of the grease.

ASTM 2266 for testing the wear preventive characteristics of greases (four balls method, at 1800 rpm, 1 h., 75° C and 40 kg/cm$^2$).

EXAMPLE I

Five parts by weight of aluminum stearate and 42 parts by weight of hydrogenated polyisobutylene having a mean molecular weight of 460, were blended at room temperature. This mixture was heated as quickly as possible with stirring. When the temperature reached about 120° C, 20 parts by weight of naphthenic oil with a viscosity index of 70 were added. This mixture was further heated and when the temperature reached 170°-180° C, 32.8 parts by weight of hydrogenated polyisobutylene having a mean molecular weight of 730 and 0.2 parts by weight of polyisobutylene having a mean molecular weight higher than 100,000 were progressively added. The temperature was kept at about 175° C during this addition with stirring. The hot grease was then withdrawn into a cooling vessel. The cooled grease was poured into a mixer and passed through a homogenizer.

The grease was smooth, stringy, homogeneous and almost colorless and transparent. The hardness was 285 (in tenth of mm. at 25° C: test ASTM 217-52T) for the unworked grease and 297 for the 60 strokes worked grease.

The wear index (ASTM 2266) was 0.72.

By way of comparison, a grease which was free from low molecular weight hydrogenated polyisobutylene required a higher amount of aluminum soap (8% by weight instead of 5%) to obtain the same hardness, and a higher quantity of adhesiveness improver (1% by weight instead of 0.2%). On the other hand, the wear index was 1.07 for this grease containing 8% by weight of aluminum soap, 1% of polyisobutylene with a molecular weight higher than 100,000 and 91% of mineral oil.

Thus, it is apparent that by using a hydrogenated polyisobutylene with a molecular weight lower than 2500, the grease requires lower amounts of thickening agents and of additives and has better lubricating and anti-wear properties.

EXAMPLE II

A grease was prepared from the following:

46.8% by weight of hydrogenated polyisobutylene with a mean molecular weight of 460

48.0% by weight of hydrogenated polyisobutylene with a mean molecular weight of 730

5.0% by weight of aluminum stearate 0.2% by weight of adhesiveness improver

This grease was smooth, homogeneous, colorless and stringy, with a penetration index of 289 and a wear index of 0.63.

By way of comparison, a grease which was also free from mineral oil but containing lithium soap instead of aluminum soap was prepared. Even with an amount of lithium soap as high as 12% by weight, this grease was less hard, the penetration being 319.

EXAMPLE III

The process of Example I was repeated for preparing a similar grease but with 39.8 parts by weight of a hydrogenated polyisobutylene with a mean molecular weight of 447 and 35.0 parts by weight of a hydrogenated polyisobutylene with a mean molecular weight of 633.

This grease was slightly less consistent (penetration, 296) but the anti-wear performance was improved (wear index 0.68).

EXAMPLE IV

The process of Example I was repeated, but with 74.8 parts by weight of hydrogenated polyisobutylene having a means molecular weight of 500.

The grease had a good mechanical stability, the penetration being 294 for the unworked grease and 295 for the worked grease (60 strokes).

The anti-wear properties were also good, the wear index being 0.70.

EXAMPLE V

The process of Example I was repeated, but by substituting a synthetic oil (di-2-ethylhexylsebacate) for the napthenic oil.

The grease also had good anti-wear properties (wear index 0.70), but was somewhat less in consistency (penetration : 340).

EXAMPLE VI TO IX

Four greases were prepared from naphthenic mineral oils (viscosity index : 70), hydrogenated polyisobutylene, aluminum soap and adhesiveness improver (polyisobutylene having a mean molecular weight higher than 100,000).

The proportions (by weight) of these components in each of the greases and the results of tests are given in the following table. The molecular weight of the polymers is given after the abbreviation PIB.

| | Ex. 6 | Ex. 7 | Ex. 8 | Ex. 9 |
|---|---|---|---|---|
| P I B 300 | | | | 33 |
| P I B 670 | 34 | 72.8 | 71.8 | 41.8 |
| Al. Stearate | 8 | | 5 | |
| Al acetopalmitate | | 7 | 3 | 5 |
| Mineral Oil | 57.8 | 20 | 20 | 20 |
| Adhesiveness improver | 0.2 | 0.2 | 0.2 | 0.2 |
| Penetration | | | | |

-continued

| | Ex. 6 | Ex. 7 | Ex. 8 | Ex. 9 |
|---|---|---|---|---|
| (unworked grease) | 301 | 287 | 285 | 304 |
| Wear index | 0.74 | 0.71 | 0.72 | 0.68 |

The primary characteristics of these greases is their consistency and anti-wear power.

By way of comparison, a grease was prepared from 54.8% by weight of mineral lubricating oil, 5% by weight of aluminum stearate, 10% by weight of polyisobutylene with a mean molecular weight of 670 and 30% by weight of polyisobutylene with a mean molecular weight of 3500. Due to the incorporation of this latter polymer, the grease was scarcely workable and mechanically applicable at low temperatures. The same disadvantage appeared with greases containing low molecular weight polyethylene and polyhexane. Also, suitable greases could not be prepared from high molecular weight polyolefins.

The grease of Example 6 was duplicated but with calcium stearate instead of aluminum stearate. The grease so produced was of substantially lower consistency.

The above results illustrate that the greases prepared according to the present invention provide substantially improved results. 9n

What is claimed is:

1. A lubrication grease composition consisting essentially of 2 to 8% by weight of an aluminum fayy acid soap, 25 to 98% by weight of hydrogenated polyisobutylene having a mean molecular weight ranging from 300 to 2500, 2 to 58% mineral lubricating oil, and 0.2% polyisobutylene having a mean molecular weight higher than 100,000, and also having a worked penetration in the range of about 285 to 340 and a wear index in the range of about 0.63 to 0.74.

2. The lubricating grease composition of claim 1 wherein said grease comprises 35 to 97% of a hydrogenated polyisobutylene having a mean molecular weight ranging from 300 to 2500, and 2 to 56% of mineral oil.

3. A lubricating grease as defined in claim 2 wherein the aluminum soap is in the range of 3 to 8%, the hydrogenated polyisobutylene is in the range of 35 to 87% and the lubricating mineral oil is in the range of 10 to 48%.

4. The lubricating grease of claim 1 wherein the aluminum soap is an aluminum soap of a carboxylic fatty acid containing from 12 to 20 carbon atoms.

5. A process for the manufacture of lubricating greases which comprise:

dispersing at 15°–50° C 2 to 8% by weight, based on the total composition, of aluminum fatty acid soap, into 10 to 50% by weight of a hydrogenated polymer of polyisobutylene said polymer having a mean molecular weight of between 300 and 2500.

progressively heating said dispersion, adding 2 to 58% by weight of mineral lubricating oil when the temperature reaches 90° to 110° C, slowly adding 0.2% polyisobutylene having a mean molecular weight higher than 100,000 and 15 to 48% by weight of a polymer of hydrogenated isobutylene, said polymer having a mean molecular weight of between 300 and 2500 when the temperature reaches 150° to 180° C, and maintaining such temperature during the addition of the polymer, cooling the mixture and homogenizing said mixture at 10° to 35° C.

6. The process of claim 5 wherein said aluminum soap is an aluminum soap of a carboxylic fatty acid containing 12 to 20 carbon atoms.

7. The process of claim 5 wherein said aluminum soap is present in quantity of 2 to 15% and said mineral oil is present in quantity of 2 to 56%.

8. The lubricating grease composition of claim 1, wherein said hydrogenated polyisobutylene is present as a mixture of substantial portions of high mean molecular weight hydrogenated polyisobutylene and low mean molecular weight hydrogenated polyisobutylene.

* * * * *